US007069823B1

(12) United States Patent
Howell

(10) Patent No.: US 7,069,823 B1
(45) Date of Patent: Jul. 4, 2006

(54) AUXILARY HANDLE DEVICE FOR USE WITH CONVENTIONAL HANDHELD SCREWDRIVERS

(76) Inventor: James Howell, 504 Crisfield Rd., Baltimore, MD (US) 21220

( * ) Notice: Subject to any disclaimer, the term of this patent is extended or adjusted under 35 U.S.C. 154(b) by 217 days.

(21) Appl. No.: 10/789,824

(22) Filed: Feb. 27, 2004

(51) Int. Cl.
*B25B 23/16* (2006.01)
*B25G 1/00* (2006.01)

(52) U.S. Cl. ..... 81/177.1; 81/180.1

(58) Field of Classification Search ..... 81/177.1, 81/177.2, 180.1; 16/110.1, 421
See application file for complete search history.

(56) References Cited

U.S. PATENT DOCUMENTS 1,632,227 A * 6/1927 Halsey ..... 16/421
2,241,965 A * 5/1941 Sjobring ..... 81/177.2
2,653,637 A * 9/1953 Rea ..... 81/177.1
2,725,086 A * 11/1955 Keyes ..... 81/15.9
3,752,202 A * 8/1973 Condon ..... 81/436
3,957,096 A * 5/1976 Rodman ..... 81/177.1
4,007,651 A * 2/1977 Scott ..... 81/175
4,102,375 A * 7/1978 Rossini ..... 81/30
D259,698 S * 6/1981 MacNeill ..... D8/107
4,437,365 A * 3/1984 Yaari ..... 81/436
4,519,278 A * 5/1985 Heldt ..... 81/427.5
4,566,357 A * 1/1986 Carossino ..... 81/177.2
4,768,406 A * 9/1988 Fitzwater ..... 81/177.1
5,005,448 A * 4/1991 Main ..... 81/63
5,551,323 A 9/1996 Beere et al.
5,819,594 A * 10/1998 Sjovall ..... 74/551.9
5,822,830 A * 10/1998 Lin ..... 16/422
5,832,791 A * 11/1998 Lin ..... 81/62
6,148,701 A 11/2000 Lee
D436,822 S 1/2001 Douglas
6,922,870 B1 * 8/2005 Tontz, Sr. ..... 16/110.1

FOREIGN PATENT DOCUMENTS

EP 127014 A2 * 12/1984

* cited by examiner

*Primary Examiner*—David B. Thomas

(57) ABSTRACT

An auxilary handle device for use with conventional handheld screwdrivers for applying additional torque and reducing muscle strain. The device includes a handle portion designed for being grasped by a human hand, and a coupling portion. The coupling portion selectively receives a handle of a conventional screwdriver. The coupling portion is operationally coupled to the handle portion such that rotation of the handle portion in a first direction imparts rotation in the first direction to the coupling portion and to the conventional screwdriver in turn. The coupling portion further comprises a cylindrical perimeter wall forming a cavity portion. The cavity portion slideably receives a portion of the handle of the conventional screwdriver. The coupling portion may further include a retaining means. The retaining means selectively secures the portion of the handle of the conventional screwdriver to the coupling portion.

12 Claims, 4 Drawing Sheets

AUXILARY HANDLE DEVICE FOR USE WITH CONVENTIONAL HANDHELD SCREWDRIVERS

BACKGROUND OF THE INVENTION

1. Field of the Invention

The present invention relates to au and more particularly pertains to a new auxilary handle device for use with conventional handheld screwdrivers for providing additional torque and reducing muscle strain.

2. Description of the Prior Art

The use of screwdrivers with specialized handles is known in the prior art. Illustrative examples include: U.S. Pat. No. 5,551,323; U.S. Pat. No. 6,148,701; and U.S. Pat. No. Des. 436,822.

While these devices fulfill their respective, particular objectives and requirements, the need remains for a device that is superior in working with a wide range of conventional screwdrivers.

SUMMARY OF THE INVENTION

While the manual screwdriver is a very useful tool, there are significant drawbacks associated with its use. Foremost is the ergonomic oversight in handle design, which contributes to the frustration and even pain that is commonly experienced by consumers when attempting to start and/or drive screws. Although many are knurled or otherwise grooved to provide better gripping, the cylindrical design of the screwdriver handle demands that power to drive and particularly to start a screw is supplied in large part from the consumer's hand and fingers. Only a limited amount of arm force can be applied to a screwdriver handle before one's hand begins to slip. Trying to drive a number of screws into hardwood or other resilient surfaces often results in sore hands.

The present invention is a specially designed attachment for screwdriver handles that features a unique ball-shaped handle. Variations on the basic ball shape include a "pistol grip" type handle, as well as other hand-friendly ergonomic designs. The base of the device, where it affixes to the screwdriver handle, would feature a circular "mouth" large enough in circumference to permit the end of most any standard screwdriver handle to be inserted to a depth of approximately two inches (2"). To secure the mouth of the device to the screwdriver handle a number of commonly used methods could be used including butterfly screws, spring clamps or a drill chuck type of clamp.

Use of the present invention would be very simple and straightforward. First, the user would slip the mouth of the device over the end of a selected screwdriver handle and securely clamped in place. Once affixed to the screwdriver handle the device would be used in very much the same way as any other screwdriver.

The present invention offers a number of important benefit and advantages. Foremost, due to the device's comfortable, oversized and ergonomically designed handle consumers would be better capable of using the strength of their arms as well as their hands, important when trying to start a screw in a hard surface. Additionally, the larger handle of this practically designed device would allow more leverage or torque to be applied when driving screws, making this task much easier and quicker. Another important benefit is related to this product's versatility. Designed to quickly and easily attach and remove, every tool found in the consumer's box possessing similar handles could make use of this device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
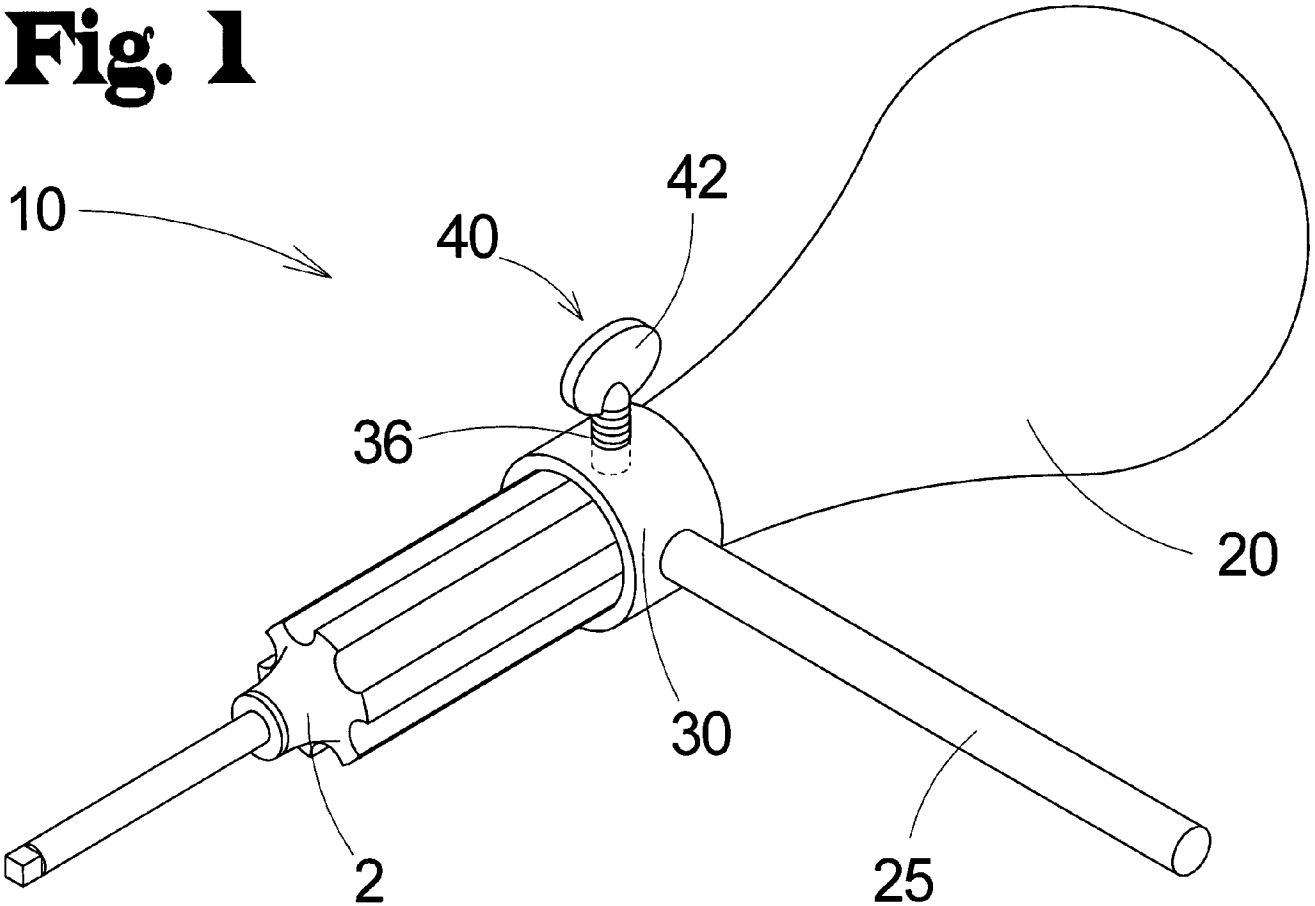
FIG. 1 is a schematic perspective view of a new auxilary handle device for use with conventional handheld screwdrivers according to the present invention.
Figure 2:
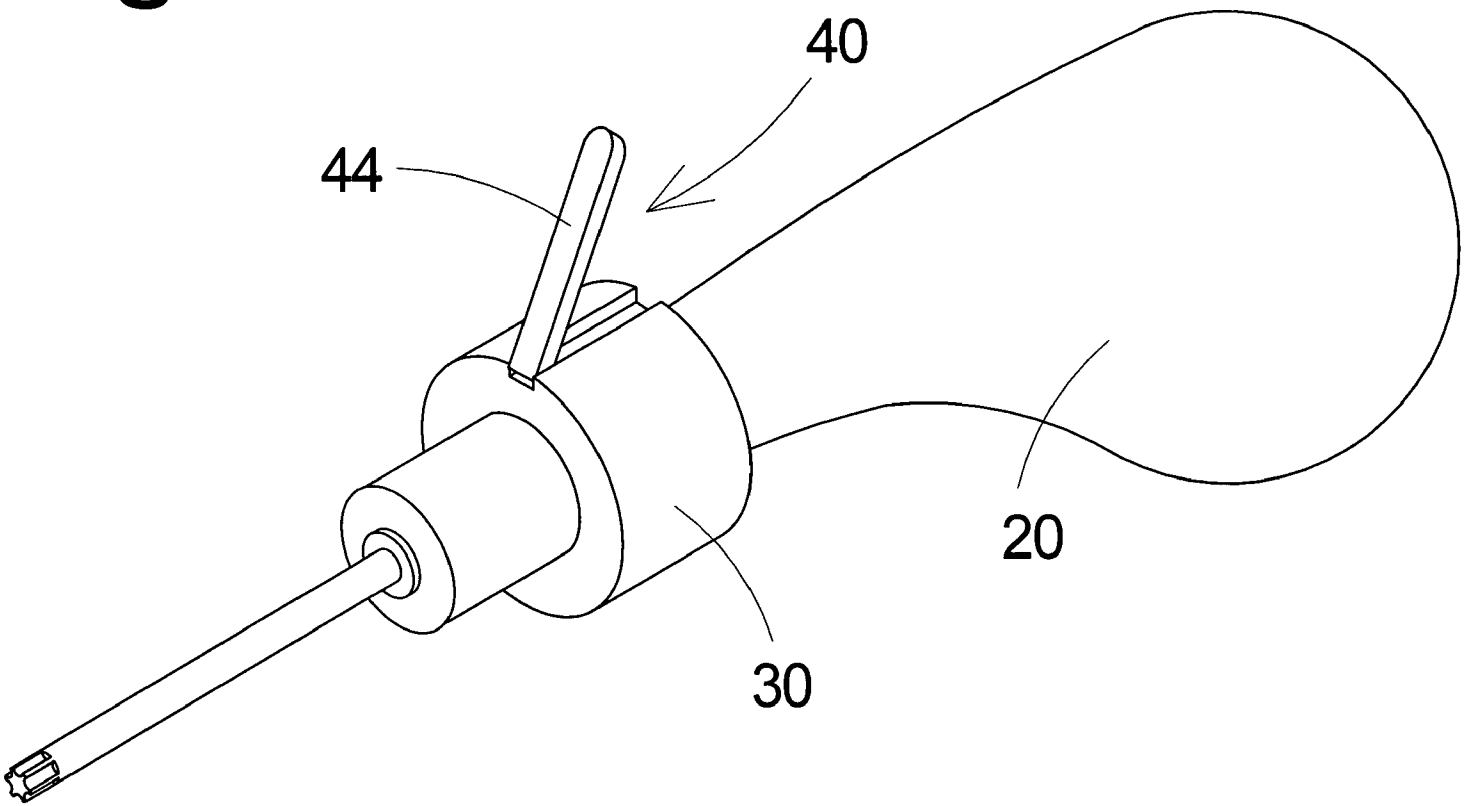
FIG. 2 is a schematic perspective view of the present invention with a spring clamp retaining means.
Figure 3:
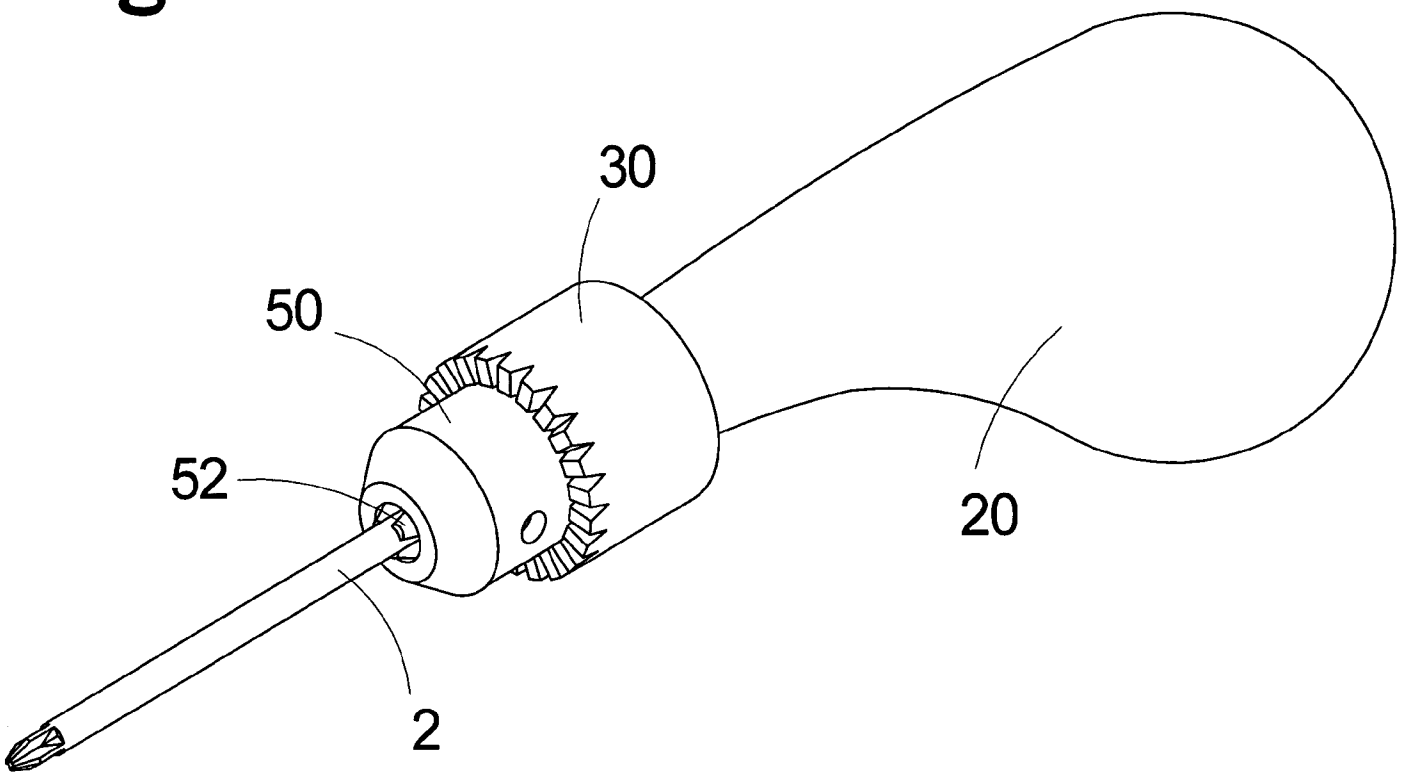
FIG. 3 is a schematic perspective view of the present invention with a chuck retaining means.
Figure 4:
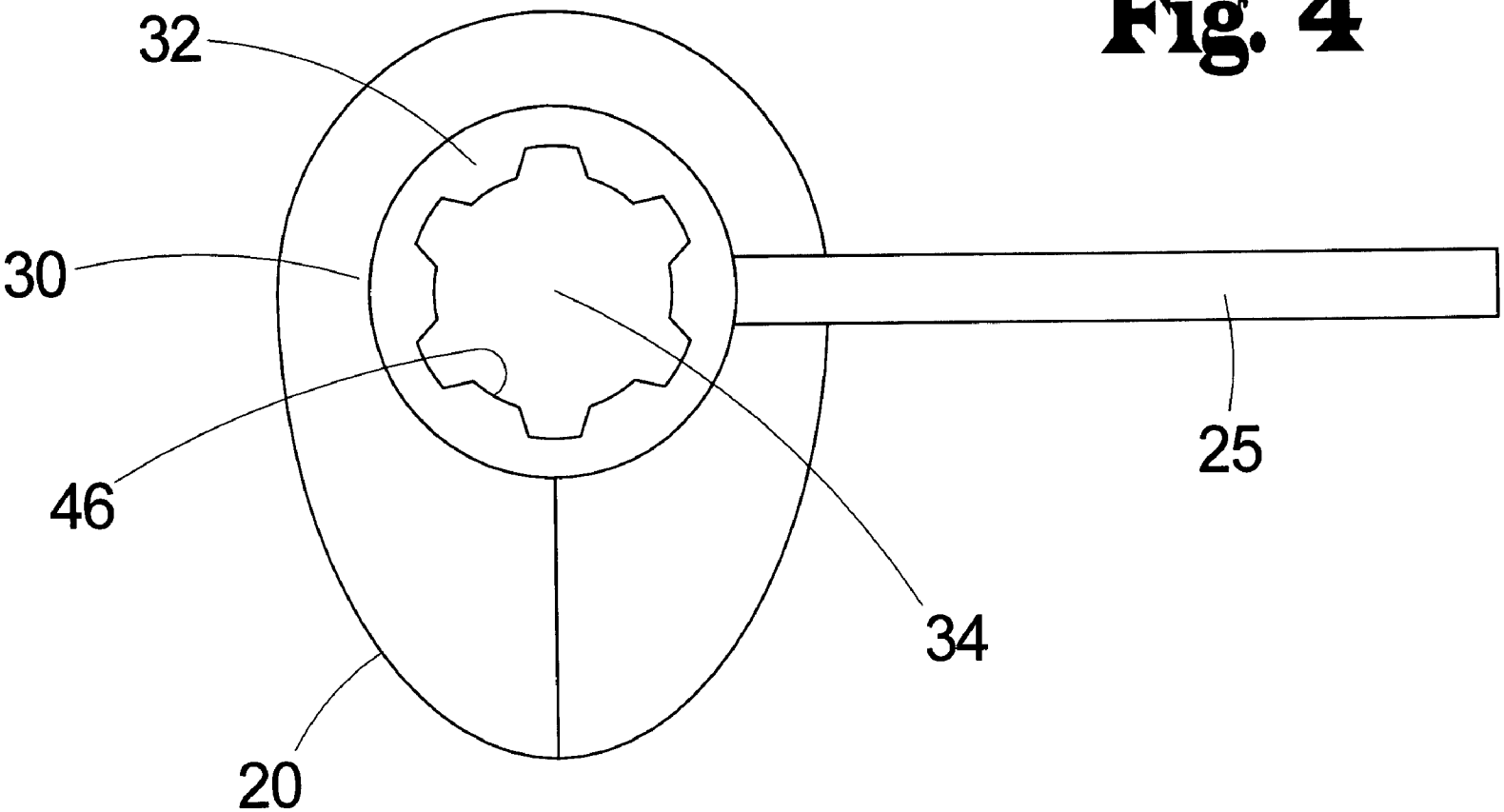
FIG. 4 is a schematic side view of the present invention showing flutes for the retaining means.

With reference now to the drawings, and in particular to FIGS. 1 through 4 thereof, a new auxilary handle device for use with conventional handheld screwdrivers embodying the principles and concepts of the present invention and generally designated by the reference numeral 10 will be described.

As best illustrated in FIGS. 1 through 4, the auxilary handle device for use with conventional handheld screwdrivers 10 generally comprises a handle portion 20 designed for being grasped by a human hand, and a coupling portion 30. The coupling portion 30 selectively receives a handle of a conventional screwdriver 2. The coupling portion 30 is operationally coupled to the handle portion 20 such that rotation of the handle portion 20 in a first direction imparts rotation in the first direction to the coupling portion 30 and to the conventional screwdriver 20 in turn.

Preferably, the coupling portion 30 further comprises a cylindrical perimeter wall 32 forming a cavity portion 34. The cavity portion 34 slideably receives a portion of the handle of the conventional screwdriver 2.

Additionally, the coupling portion 30 may further include a retaining means 40. The retaining means 40 selectively secures the portion of the handle of the conventional screwdriver 2 to the coupling portion 30.

A leverage bar member 25 may be operationally coupled to the coupling portion 30. The leverage bar member 25 is positioned such that it is substantially perpendicular to the handle portion 20 when the leverage bar member 25 is operationally coupled to the coupling portion 30. The leverage bar member 25 facilitates application of additional torque to the conventional screwdriver 2.

In an embodiment the retaining means 40 comprises a threaded aperture 36 extending through the perimeter wall 32, and a screw 42 which can be threaded through the aperture 36 to create an interference fit with the portion of the handle of the conventional screwdriver 2 and an interior surface of the perimeter wall 32.

In a further embodiment a pair of threaded apertures 34 and a pair of screws 42 are utilized as the retaining means 40 to create an interference fit with the portion of the handle of the conventional screwdriver 2.

In another embodiment the retaining means 40 is a spring clamp 44.

In a further embodiment the retaining means 40 further comprises a series of flutes 46 positioned around an interior portion of the perimeter wall 32. The flutes 46 are aligned with a series of grooves extending along the handle of the conventional screwdriver 2 when the handle is received in the coupling portion 30. The flutes 46 and the grooves inhibit rotation of the screwdriver 2 with reference to the coupling portion 30.

In still a further embodiment the retaining means 40 further comprises a chuck assembly 50. The chuck assembly 50 includes a jaw portion 52 closable around the portion of the handle of the conventional screwdriver 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An auxiliary handle device for use in conjunction with handheld screwdrivers of the type including a shaft and a handle having a plurality of longitudinally-oriented and alternating flutes and channels, the device comprising:

a handle portion adapted for being grasped by a human hand; and a coupling portion defining a cavity configured to slidably and releasably receive a portion of the handle of the screwdriver, said coupling portion being coupled to said handle portion such that rotation of said handle portion in a first direction imparts rotation in said first direction to said coupling portion and to the screwdriver in turn;

wherein said handle portion has an exterior surface, said exterior surface having a substantially spherical portion and a substantially frustaconical portion extending between said substantially spherical portion and said coupling portion;

wherein said coupling portion further comprises a retaining means for selectively securing said coupling portion to the portion of the handle of the screwdriver; and a leverage bar for facilitating application of additional torque to the handle of the screwdriver, said leverage bar being coupled to said coupling portion, said leverage bar having a longitudinal axis, said leverage bar member being positioned such that said longitudinal axis of said leverage bar extends substantially perpendicular to a longitudinal axis of said handle portion when said leverage bar is coupled to said coupling portion.

2. The auxiliary handle device of claim 1, wherein said coupling portion further comprises a cylindrical perimeter wall forming a cavity portion, said cavity portion slideably receiving a portion of the handle of the screwdriver.

3. The auxiliary handle device of claim 1, further comprising:

an aperture extending through said perimeter wall, said aperture having threads applied thereupon; and said retaining means being a screw, said screw being threadable through said aperture to create an interference fit with the portion of the handle of the screwdriver and an interior surface of said perimeter wall.

4. The auxiliary handle device of claim 1, further comprising:

a pair of apertures, each one of said apertures extending through an associated side of said perimeter wall, said apertures having threads applied thereupon; and said retaining means being a pair of screws, each one of said pair of screws being threadable through an associated one of said pair of apertures to create an interference fit with the portion of the handle of the screwdriver.

5. The auxiliary handle device of claim 1, wherein said retaining means further comprises a spring clamp.

6. The auxiliary handle device of claim 1, wherein said retaining means further comprises a series of flutes positioned around an interior portion of said perimeter wall, said flutes being configured to be alignable with the grooves in the handle of the screwdriver to inhibit rotation of the screwdriver relative to the coupling portion.

7. The auxiliary handle device of claim 1, wherein said retaining means further comprises a chuck assembly, said chuck assembly having a jaw portion closable around the portion of the handle of the screwdriver.

8. An auxiliary handle device for use in conjunction with handheld screwdrivers of the type including a shaft and a handle having a plurality of longitudinally-oriented and alternating flutes and channels, the device comprising:

a handle portion adapted for being grasped by a human hand;

a coupling portion, said coupling portion selectively receiving a handle of a screwdriver, said coupling portion being operationally coupled to said handle portion such that rotation of said handle portion in a first direction imparts rotation in said first direction to said coupling portion and to the screwdriver in turn;

said coupling portion further comprises a cylindrical perimeter wall forming a cavity portion, said cavity portion slideably receiving a portion of the handle of the screwdriver;

said coupling portion further comprises a retaining means, said retaining means selectively securing the portion of the handle of the screwdriver to said coupling portion; and a leverage bar member operationally couplable to said coupling portion, said leverage bar member having a longitudinal axis, said leverage bar member being positioned such that said longitudinal axis of said leverage bar member is substantially perpendicular to a longitudinal axis of said handle portion when said leverage bar member is operationally coupled to said coupling portion, said leverage bar member facilitating application of additional torque to the screwdriver;

wherein said retaining means further comprises a series of flutes positioned around an interior of said perimeter wall forming said cavity portion, said flutes being configured to be alienable with grooves extending along the handle of the screwdriver to inhibit rotation of the screwdriver relative to the coupling portion.

9. The auxiliary handle device of claim 8, wherein said handle portion substantially bulbous shaped.

10. The auxiliary handle portion of claim 8, wherein said handle portion is substantially shaped as a pistol grip.

11. In combination:

a handheld screwdriver including a shaft and a handle having a plurality of longitudinally-oriented and alternating flutes and channels; and an auxiliary handle device removably mounted on the screwdriver, the device comprising:

a handle portion adapted for being grasped by a human hand, said handle portion having an exterior surface, said exterior surface having a substantially spherical portion and a substantially frustaconical portion positioned adjacent to said substantially spherical portion; and a coupling portion defining a cavity slidably and releasably receiving a portion of said handle of said screwdriver;

a retaining means on said coupling portion for selectively retaining and securing said coupling portion to the portion of the handle of the screwdriver such that rotation of said handle portion and said coupling portion in a first direction imparts rotation in said first direction to said screwdriver in turn;

wherein said retaining means further comprises a series of flutes positioned around an interior portion of said perimeter wall, said flutes being alignable with a series of grooves extending along the handle of the screwdriver, said flutes and the grooves inhibiting rotation of the screwdriver with reference to the coupling portion.

12. The combination of claim 11, wherein the auxiliary handle device additionally comprises a leverage bar for facilitating application of additional torque to the handle of the screwdriver, said leverage bar being coupled to said coupling portion, said leverage bar having a longitudinal axis, said leverage bar member being positioned such that said longitudinal axis of said leverage bar extends substantially perpendicular to a longitudinal axis of said handle portion when said leverage bar is coupled to said coupling portion.

* * * * *